US005924265A

United States Patent [19]

Auerbach

[11] Patent Number: 5,924,265

[45] Date of Patent: Jul. 20, 1999

[54] VACUUM DECK STOPPING MECHANISM

[75] Inventor: David R. Auerbach, West Redding, Conn.

[73] Assignee: Pitney Bowes Inc., Stamford, Conn.

[21] Appl. No.: 09/001,757

[22] Filed: Dec. 31, 1997

[51] Int. Cl.[6] ..... B65B 43/26; B65B 43/52

[52] U.S. Cl. ..... 53/460; 53/381.6; 53/569

[58] Field of Search ..... 53/460, 492, 468, 53/469, 467, 473, 569, 206, 284.3, 249, 250, 381.6

[56] References Cited

U.S. PATENT DOCUMENTS

| | | | |
|---|---|---|---|
| 5,255,498 | 10/1993 | Hotchkiss et al. | 53/569 |
| 5,388,388 | 2/1995 | Belec et al. | 53/460 |
| 5,414,977 | 5/1995 | Cohen | 53/460 |
| 5,428,944 | 7/1995 | Belec et al. | 53/492 |
| 5,581,972 | 12/1996 | Antonelli | 53/284.3 X |
| 5,651,238 | 7/1997 | Belec et al. | 53/381.6 X |

*Primary Examiner*—James F. Coan
*Attorney, Agent, or Firm*—Christopher J. Capelli; Melvin J. Scolnick; Robert Meyer

[57] ABSTRACT

A backstop member for use in an insertion station operative to insert an enclosure collation into an open end of an envelope. The insertion station having a deck with a transport mechanism for conveying an envelope, an opening mechanism for opening an envelope and a backstop member mounted below the deck for stopping the envelope in the insertion station preparatory to insertion of the enclosure collation. The backstop member includes an elongate stopping portion having a substantially planar surface configured to abut against and prevent travel of an envelope in the insertion station being driven by the transport mechanism when the elongate stopping portion is caused to extend above the deck. The backstop member also provides a cam portion having an ellipsoid configuration dimensioned to cause a portion of the envelope being driven by the deck transport mechanism to travel over the ellipsoid configuration and away from the deck in the insertion station when the cam portion is caused to extend above the deck.

9 Claims, 5 Drawing Sheets

VACUUM DECK STOPPING MECHANISM

FIELD OF THE INVENTION

The present invention relates generally to multi-station document inserting systems, which assemble batches of documents for insertion into envelopes. More particularly, the present invention is directed toward an envelope insertion station having a vacuum deck with a stopping mechanism for both stopping an envelope on a vacuum deck and lifting a portion of an envelope away from the vacuum deck.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the 8, 9 and 14 series inserter systems available from Pitney Bowes, Inc., Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation. For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to the burster-folder station for separating and folding. A control scanner located in the burster-folder station senses the control marks on the control documents. Thereafter, the serially arranged insert feeder stations sequentially feed the necessary documents onto a transport deck at each station as the control document arrives at the respective station to form a precisely collated stack of documents which is transported to the envelope feeder-insert station where the stack is inserted into the envelope. The transport deck preferably includes a ramp feed so that the control documents always remain on top of the stack of advancing documents. A typical modern inserter system also includes a control system to synchronize the operation of the overall inserter system to ensure that the collations are properly assembled.

In regards to the envelope insertion station, they are critical to the operation of document inserting systems. Typically, such an envelope insert device inserts collated enclosures into a waiting envelope. Envelope inserting machines are used in a wide range of enclosure thickness' and also with enclosures which are not significantly different in length than the length of the envelopes into which they are inserted. The difference between the length of the enclosures and the envelope should be minimized so that the addressing information printed on the enclosure which is intended to appear in the envelope window does not shift in position and become hidden.

Regarding the operation of such envelope insertion stations, a preferred mode of operation has been to use continuously running transport belts on the deck of the insertion station, wherein the envelope resides atop the transport belts. When an envelope is caused to feed into the envelope station the continuously running transport belts cause the envelope to convey downstream in the insertion station. Once the envelope is in an insertion position, a stopping member is caused to obstruct the conveying path of the envelope, thus preventing the forces of the transport belts to further convey the envelope.

A known difficulty associated with such envelope insertion stations is maintaining the envelope stabile during the insertion process. This is because the continuos running transport belts beneath the envelope may cause the envelope to move (jitter) while it is abutting against a stopping member preparatory to insertion of an enclosure collation. This jittering movement of the envelope may cause it to misalign with respect to an enclosure collation being conveyed toward the envelope awaiting insertion thereof The misalignment will often cause misfeed of the enclosure collation into the envelope, thus causing a paper jam in the insertion station.

In overcoming the above-mentioned drawbacks, vacuum decks have been implemented in envelope insertion stations that effectively stabilize an envelope while it is abutting against a stopping member and residing atop the continues running transport belts. See for example commonly assigned U.S. Pat. No. 5,428,944. However an associated drawback of this arrangement is that the vacuum deck may impede the forward travel of an envelope once the stopping members are removed from the envelopes travel path after the envelope has been inserted with an enclosure collation. Since modern inserter system operate at high speeds, any impediment in its paper path can significantly lessen its throughput speed.

Therefore it is an object of the present invention to overcome the difficulties associated with envelope insertion stations utilizing vacuum decks for stabilizing an envelope during insertion of an enclosure collation.

SUMMARY OF THE INVENTION

Accordingly, the instant invention provides a system for transporting, deskewing and stopping an envelope in an envelope insertion station. The system includes a plurality of laterally spaced, continuously moving, endless transport belts for conveying an envelope in the insertion station A stationary vacuum deck is provided that includes longitudinal grooves, each of the grooves accommodating an upper reach of a corresponding one of the continuos moving transport belts. The vacuum deck includes a plurality of vacuum ports arranged in longitudinal rows, each of the rows being adjacent at least one of the transport belts wherein vacuum is continuously present at each vacuum port. Also provided is a plurality of stop members located at the downstream end of the vacuum deck wherein vacuum at the vacuum ports urge an envelope against the continuously moving transport belts which transport the envelopes to the stop members. Each stop member includes an elongate stopping portion having a substantially planar surface configured to abut against and prevent travel of an envelope in the insertion station being driven by the transport belts when the elongate stopping portion is caused to extend above the vacuum deck. Each stop member further includes a cam portion having an ellipsoid configuration dimensioned to cause a portion of the envelope being driven by the transport belts to travel over the ellipsoid configuration and away from the vacuum deck in the insertion station when the cam portion is caused to extend above the vacuum deck.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 1:
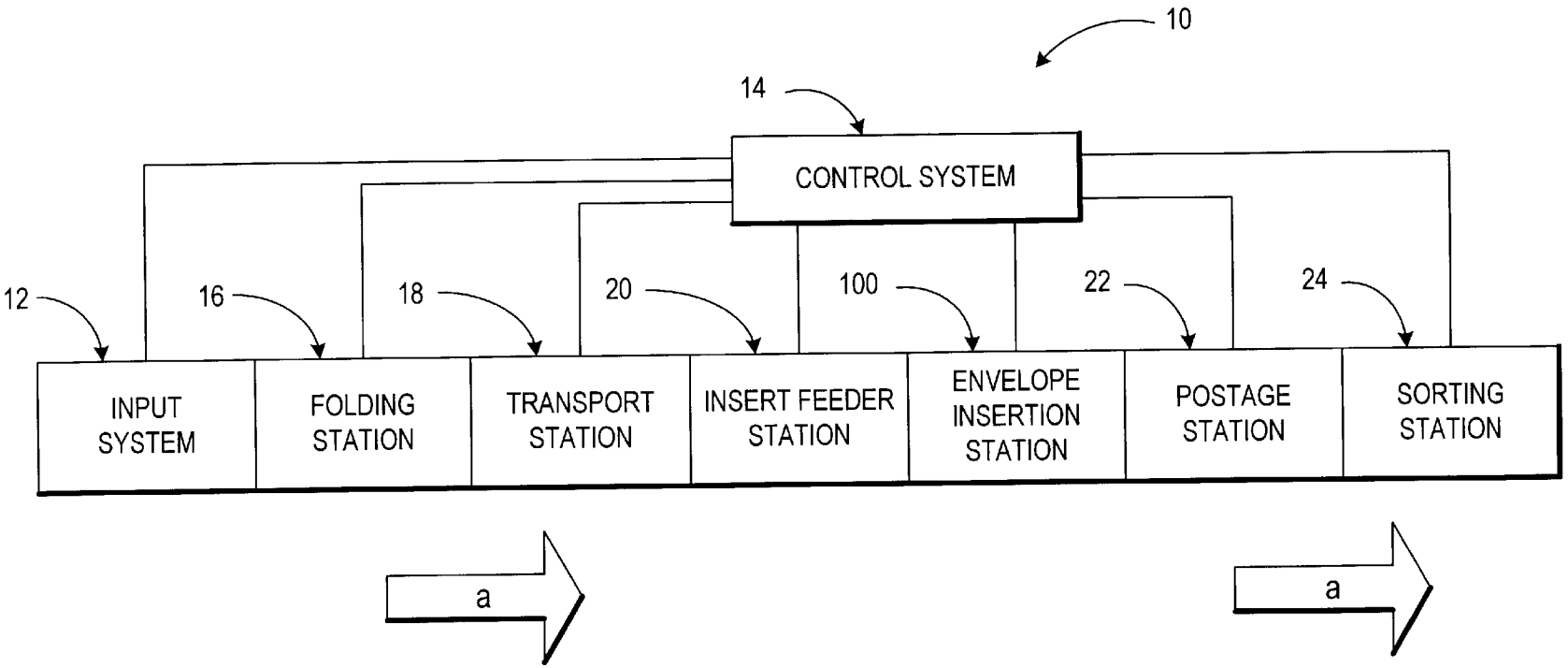
FIG. 1 is a block diagram schematic of a document inserting system in which the present invention envelope insertion station is incorporated.

In describing the preferred embodiment of the present invention, reference is made to the drawings, wherein there is seen in FIG. 1 a schematic of a typical document inserting system, generally designated 10, which implements the present invention insertion station 100. In the following description, numerous paper handling stations implemented in inserter system 10 are set forth to provide a thorough understanding of the operating environment of the present invention. However it will become apparent to one skilled in the art that the present invention may be practiced without the specific details in regards to each of these paper-handling stations.

As will be described in greater detail below, system 10 preferably includes an input system 12 that feeds paper sheets from a paper web to an accumulating station that accumulates the sheets of paper in collation packets. Preferably, only a single sheet of a collation is coded (the control document), which coded information enables the control system 14 of inserter system 10 to control the processing of documents in the various stations of the mass mailing inserter system. The code can comprise a bar code, UPC code or the like.

Essentially, input system 12 feeds sheets in a paper path, as indicated by arrow "a," along what is commonly termed the "main deck" of inserter system 10. After sheets are accumulated into collations by input system 12, the collations are folded in folding station 16 and the folded collations are then conveyed to a transport station 18, preferably operative to perform buffering operations for maintaining a proper timing scheme for the processing of documents in inserting system 10.

Each sheet collation is fed from transport station 18 to insert feeder station 20. It is to be appreciated that a typical inserter system 10 includes a plurality of feeder stations, but for clarity of illustration only a single insert feeder 20 is shown. Insert feeder station 20 is operational to convey an insert (e.g., an advertisement) from a supply tray to the main deck of inserter system 10 so as to be combined with the aforesaid sheet collation conveying along the main deck. The sheet collation, along with the nested insert(s), are next conveyed into the present invention envelope insertion station 100 that is operative to first open the envelope and then insert the collation into the opening of the envelope. The envelope is then preferably conveyed to postage station 22 that applies appropriate postage thereto. Finally, the envelope is preferably conveyed to sorting station 24 that sorts the envelopes in accordance with postal discount requirements.

As previously mentioned, inserter system 10 includes a control system 14 coupled to each modular component of inserter system 10, which control system 14 controls and harmonizes operation of the various modular components implemented in inserter system 10. Preferably, control system 14 uses an Optical Character Reader (OCR) for reading the code from each coded document. Such a control system is well known in the art and since it forms no part of the present invention, it is not described in detail in order not to obscure the present invention. Similarly, since none of the other above-mentioned modular components (namely: input system 12, folding station 16, transport station 18, insert feeder station 20, postage station 22 and sorting station 24) form no part of the present invention envelope insertion station 100, further discussion of each of these stations is also not described in detail in order not to obscure the present invention. Moreover, it is to be appreciated that the depicted embodiment of inserter system 10 implementing the present invention enclosure insertion station 100 is only to be understood as an example configuration of such an inserter system 10. It is of course to be understood that such an inserter system may have many other configurations in accordance with a specific user's needs.

Figure 2:
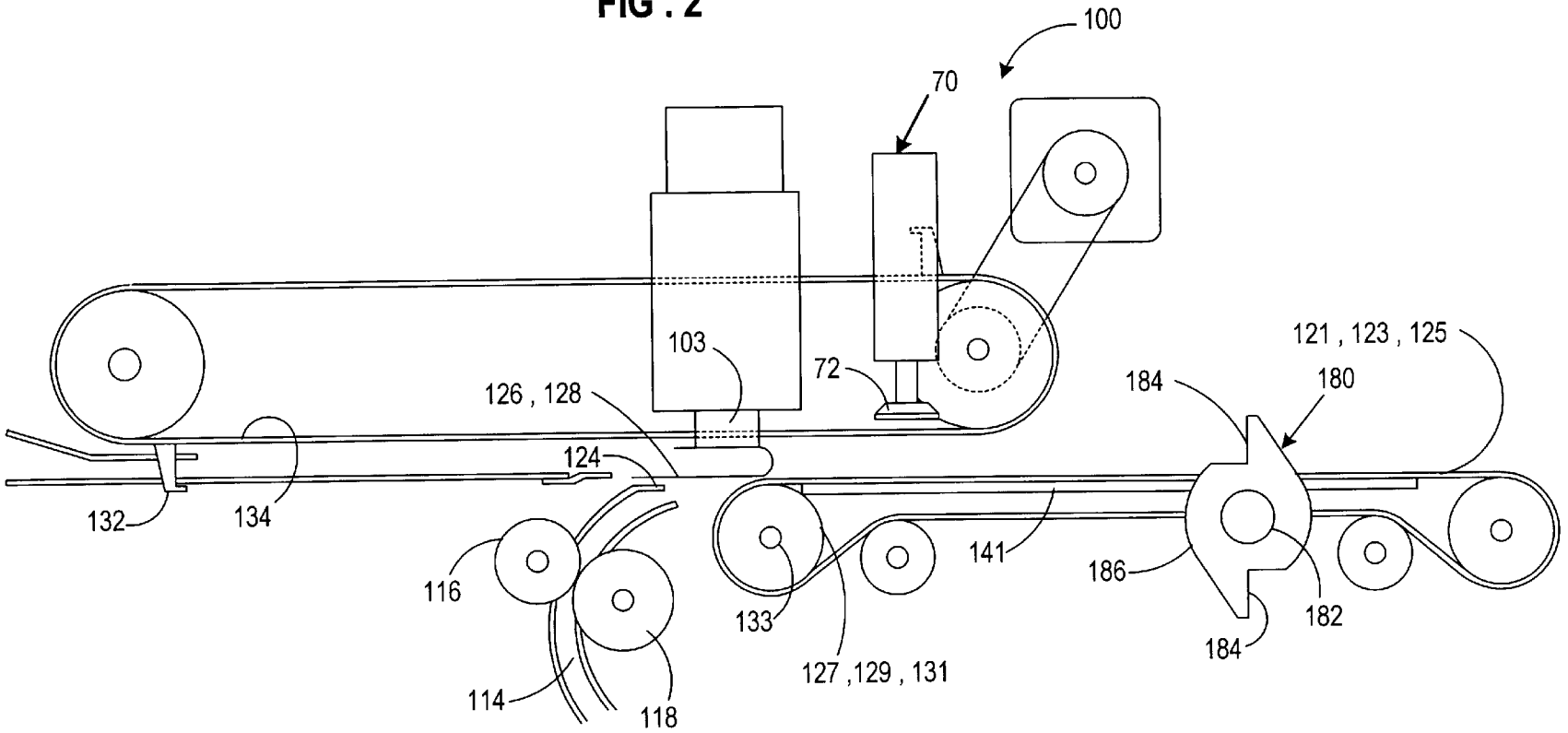
FIG. 2 is a side elevational view of the present invention envelope insertion station.
Figure 3:
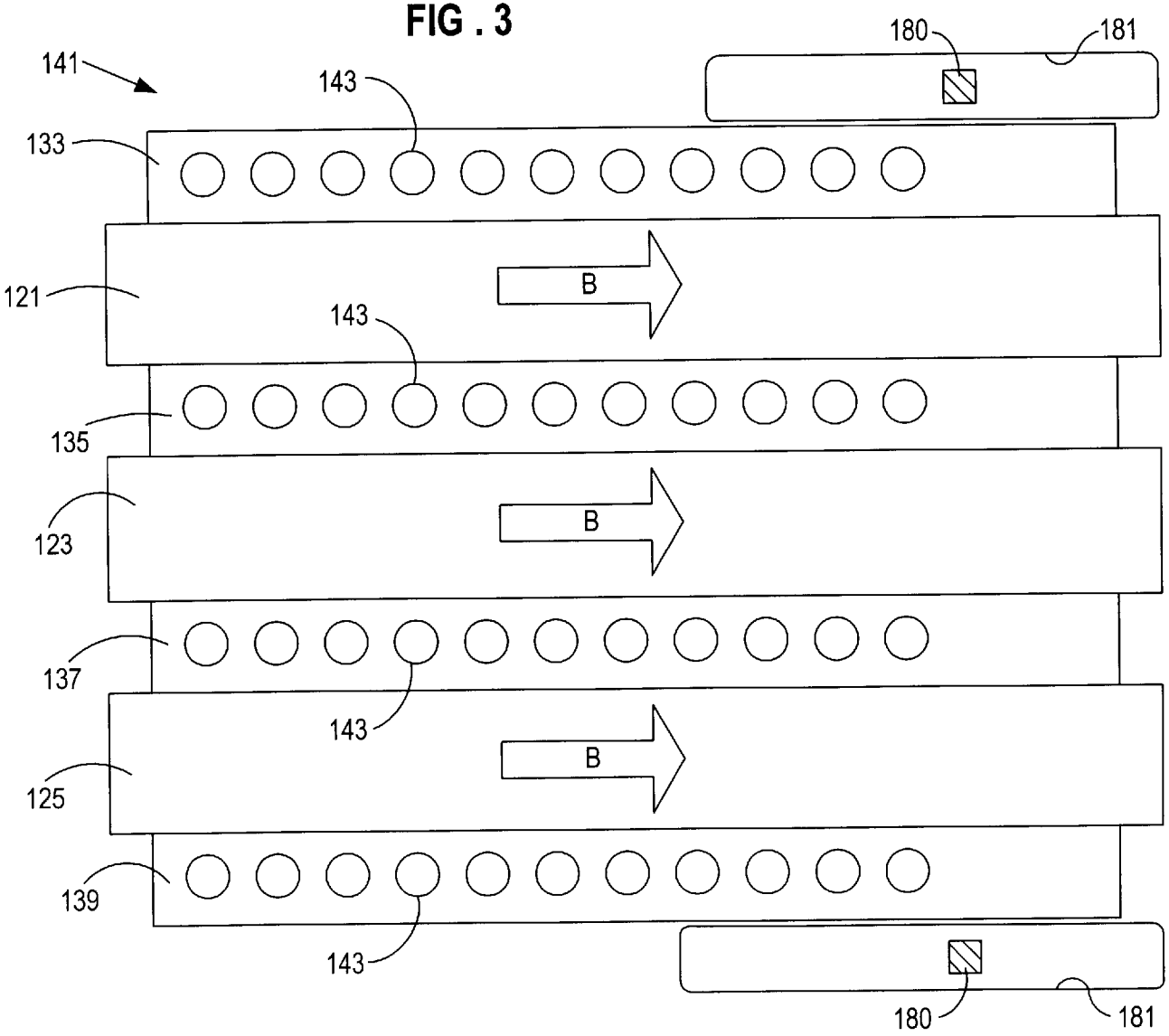
FIG. 3 is a top planar view of the transport deck of the insertion station of FIG. 2.

Referring now to FIGS. 2 and 3, the present invention insertion device 100 is shown. For simplicity, FIG. 2 depicts an insertion station 100 without illustrating any enclosure collations or envelopes. In operation, an envelope enters the insertion station 100 along a guide path 114 and is transported into the insertion station 100 by a set of transport rollers 116 and 118 and continuously running transport belts 121, 123 and 125. Each transport belt 121, 123 and 125 respectively wraps around rollers 127, 129 and 131, each roller being connected to a common shaft 133. As best shown in FIG. 3, each transport belt 121, 123 and 125 is juxtaposed between deck strips 133, 135, 137 and 139, which deck strips form the transport deck 141 of insertion station 100.

In the preferred embodiment, each deck strip 133, 135, 137 and 139 may be secured by a tongue and groove fitting spanning both sides of each deck strip or by a removable fastener at both ends. In the present embodiment, the deck strips 133, 135, 137 and 139 are secured by a tongue and groove fitting.

With continued reference to FIG. 3, the top surface of each deck strip 133, 135, 137 and 139 defines a plurality of vacuum plenums 143, whereby each vacuum plenum 143 is in communication with a vacuum source so as to create a vacuum on the top surface of each deck strip 133, 135, 137 and 139. Such a vacuum on the top surface of the transport deck 141 is operative to force an envelope to adhere to each transport belt 121, 123 and 125 because the top surface of each belt 121, 123 and 125 is positioned in a plane above that of each deck strip 133, 135, 137 and 139 and the aforesaid vacuum force created on the transport deck 141 forces an envelope against each transport belt 121, 123 and 125.

As will be appreciated further below, the motion of each transport belt 121, 123 and 125 is continues for maintaining registration of an envelope 112 against a backstop 180. Continuous vacuum from each of the deck strips 133, 135, 137 and 139 (via their respective vacuum plenums 143) prevents any jiggling of the envelope even though the transport belts 121, 123 and 125 are continuously running beneath. It is also to be appreciated that this configuration is known in the art, see commonly assigned U.S. Pat. No. 5,428,944 hereby incorporated by reference.

Rotating backstop members 180 are preferably located outside vacuum deck strips 133 and 139 in an elongate slot 181. It is to be appreciated that it is advantageous to mount the backstop members 180 as far apart from one another as possible for providing stability for the envelope while it is abutting against the backstop members 180 with the transport belts 121, 123 and 125 continuously running beneath. It is noted that the backstop members 180 cannot be located too far apart since they must be positioned to accommodate small envelopes. However, this may cause the side edges of such a small envelope to fall within the slots 181 that allow the backstop members 180 to move forward and back for different envelope depths. Thus, it is then possible for such a small envelope to snag within the slots 181 when exiting the insertion station 100. But, as will be explained below, one of the advantages of the backstop members 180 is that they each provide a cam portion 186 that functions to lift a portion of the envelope away from the vacuum deck 141 and also up and away from the slots 181. Therefore, the cam portion 186 of each backstop member 180 ensures that small envelopes will not get snag in a slot 181 through their lifting action.

Figure 4:
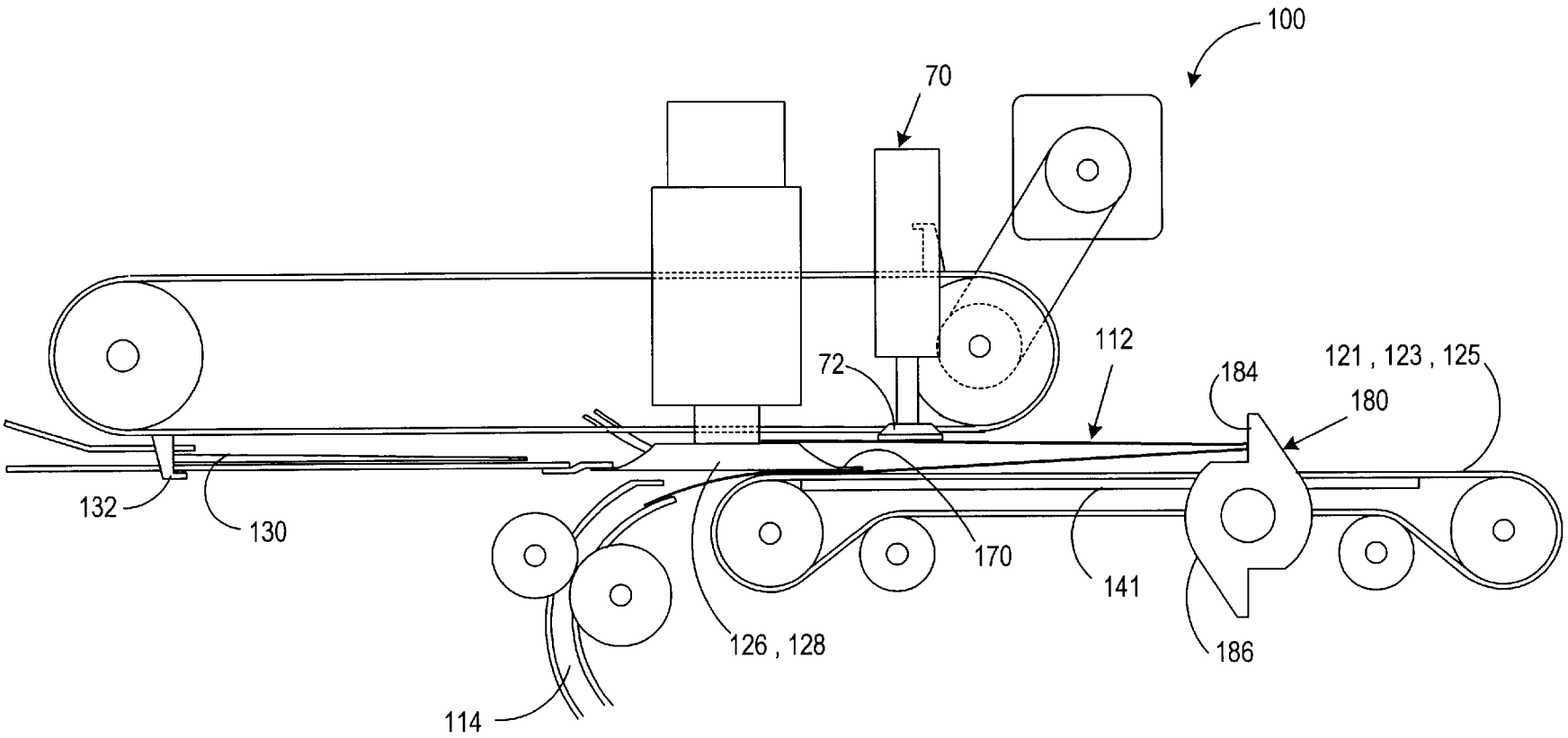
FIG. 4 is similar to FIG. 2 but depicts the back panel of an envelope being separated from its front panel through the action of a vacuum cup.

Each backstop member 180 is concentrically mounted about a common shaft 182 for effecting rotation thereof As best shown in FIG. 4, each backstop member 180 is formed with elongate stopping portions 184 each having a substantially planar profile located 180° apart from each other with a cam portion 186 extending between each elongate stopping portion 184. As will be discussed further below, each stopping portion 184 is configured to stop an envelope thereagainst when it is caused to extend above the deck 141 of insertion station 100. In other words, the stopping portions 184 create a "wall" against which an incoming envelope will stop. All backstop members 180 are fixed to a single axle 182 located beneath vacuum transport deck 141 that spans the width of the transport deck 141. And each cam portion 186 is configured to lift a portion of an envelope away from the vacuum deck 141 of the insertion station 100.

Preferably, a servo motor (not shown) causes rotation of the backstops members 180 about axle 182. The entire mechanism is housed on a carriage (not shown) such that the position of the backstop members 180 can be adjusted toward and away from the proximal end of the vacuum transport deck 141 for handling a variety of envelope sizes.

Returning reference to FIGS. 2 and 4, insertion station 100 includes envelope flap retainers 124 and rotating insertion horns 126 and 128 each having an underside that assists in helping an envelope conform to each transport belt 121, 123 and 125 while not presenting any catch points for the leading edge of the enclosure collation 130 to be inserted in a waiting open envelope 112. The horns 126 and 128 are supported from above the envelope path and are eccentrically mounted on pivot shafts 103. They are positioned perpendicular to the path of the envelope travel as the envelope is conveyed to backstop members 180. And once the vacuum assembly 70 has begun to open the envelope, the insertion horns 126 and 128 pivot into the envelope and continue their pivoting motion until the extreme edges of the envelope have been shaped and supported by the profile of each horn 126 and 128. Rotating insertion horns 126 and 128 perform the additional function of centering envelope 112 in the path of the oncoming enclosure collation 130. At this time an oncoming enclosure collation 130 may be introduced and pushed through the insertion horns 126 and 128 into a waiting envelope 112. The pivot shaft of each insertion horn 126 and 128 is driven by a servo motor (not shown).

Insertion station 100 further includes an envelope opening vacuum assembly 70 for separating the back panel of an envelope from its front panel. Vacuum assembly 70 is located perpendicular to the transport deck 141 of insertion station 100. Vacuum assembly 70 includes a reciprocating vacuum cup 72 that translates vertically downward toward the surface of the transport deck 141 and then upward away from the transport deck 141 to a height sufficient to allow a stuffed envelope to pass thereunder. As will be further discussed below, the vacuum cup 72 adheres to the back panel of an envelope, through a vacuum force present in vacuum cup 72 so as to separate the envelopes back panel away from its front panel during upward travel of the vacuum cup 72.

Preferably, the enclosure collations 130 are fed into the insertion station 100 by means of a pair of overhead pusher fingers 132 extending from a pair of overhead belts 134 relative to the deck of inserter system 10. As with the envelope 112, the top side of the envelope flap retainers 124 and the associated interior of the insertion horns 126, 128 must not present any catch points for the leading edge of the enclosure collation 130.

With the structure of the insertion station 100 being described above, its method of operation will now be discussed. Referring to FIG. 2, an envelope 112 is conveyed to the transport deck 141 of insertion station 100 via guide path 114 (which is in connection with an envelope supply (not shown)). Once a portion of the envelope 112 contacts the continuous running transport belts 121, 123 and 125, these transport belts convey envelope 112 downstream (as indicated by arrow B, FIG. 3) in insertion station 100. Concurrently, each deck strip 133, 135, 137 and 139 (FIG. 3) of transport deck 141 provides a continuous vacuum force upon envelope 112 (via vacuum plenums 143) so as to force envelope 112 against the continuous running transport bets 121, 123 and 125, as previously mentioned. Next, an elongate stopping portion 184 of backstop member 180 is caused to extend above the transport deck 141 at a height sufficient to stop travel of the envelope 112 in insertion station 100. As shown in FIG. 4, the leading edge of the envelope 112 then abuts against the stopping portion 184 of backstop member 180 so as to prevent further travel of the envelope 112.

Again, it is to be appreciated that eventhough the envelope 112 is abutting against the stopping portion 184 of backstop member 180, the transport belts 121, 123 and 125 are continuously running beneath the envelope 112. To prevent jiggling of the envelope 112 (as would be caused by the continuous running transport belts 121, 123 and 125) the continuos vacuum force affected on the envelope 112 by the deck strips 133, 135, 137 and 139 functions to stabilize the envelope 112 on the transport deck 141 while it is abutting against backstop member 180. As previously mentioned, if the envelope 112 were permitted to jiggle on the transport deck 141 preparatory to insertion of an enclosure collation 130, this significantly increases the probability that an enclosure collation 130 would misfeed into the envelope 112.

Still referring to FIG. 4, with an envelope 112 disposed in insertion station 100, the vacuum cup 72 of vacuum assembly 70 is caused to reciprocate downward toward the back panel of envelope 112 whereafter it adheres to the back panel and then reciprocates upwards so as to separate the back panel from the envelopes front panel to create an open channel in the envelope 112. An enclosure collation 130 is then conveyed by pusher fingers 132 toward envelope 112. At first, the insertion horns 126, 128 are positioned in a first position wherein their respective stripper blade portions 170 are positioned outside of the open end of the closed envelope 112 (FIG. 2). Before the conveying enclosure collation 130 is advanced into the open channel of envelope 112, each insertion horn 126 and 128 is pivoted towards its second position, approximately 65°. When pivoted the insertion horns 126 and 128 provide a guide path into the open channel of the envelope 112 into which an enclosure collation 130 travels through and into the envelope 112.

Figure 5:
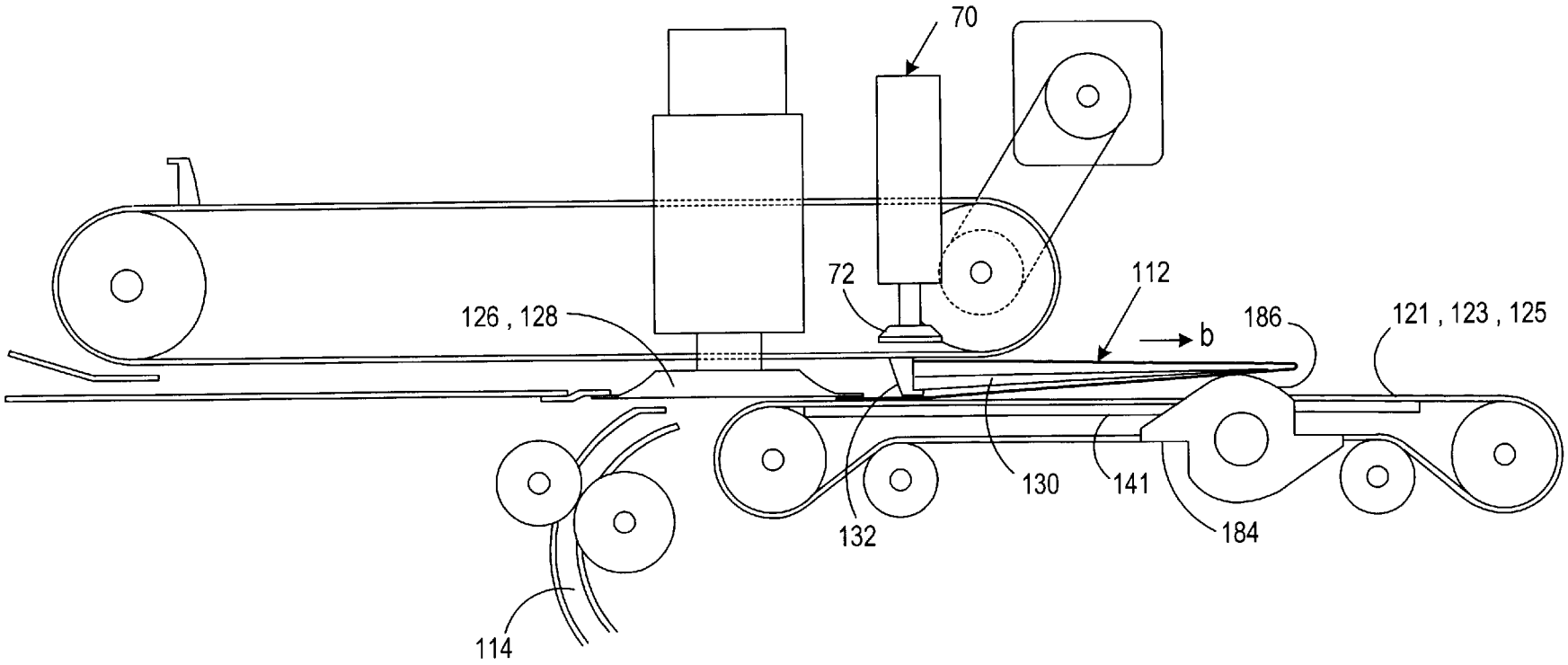
FIG. 5 is similar to FIG. 4 but depicts the stopping members being rotated to a position so as to lift a portion of an envelope away from the vacuum transport deck of the envelope insertion station.

Referring now to FIG. 5, after the enclosure collation 130 is inserted into the envelope 112, the insertion horns 126 and 128 are caused to pivot, preferably 65°, back to the first position (FIG. 2) and the vacuum force of the vacuum cups 72 is terminated thus releasing it adherence to the envelopes back panel. The backstop member 180 is then rotated approximately 90° such that its elongate stopping portion 184 is caused to rotate below the top surface of the transport deck 141 and its cam portion 186 is then caused to extend above the top surface of the transport deck 141. Since the elongate stopping portion 184 is rotated below the transport deck 141, the continuous running transport belts 121, 123 and 125 once again causes the envelope 112 to convey along the transport deck 141 in the downstream direction (as indicated by arrow B).

It is to be appreciated that since the cam portion 186 of backstop member 180 is extending above the transport deck 141, the leading edge of the envelope 112 rides over the ellipsoid configuration of cam portion 186 causing the leading edge portion of the envelope 112 to lift away from the transport deck 141, particularly deck strips 133, 135, 137 and 139. Since the leading edge portion of envelope 112 has lifted away from the later deck strips, this portion of the envelope also breaks its vacuum connection with the transport deck 141 enabling the envelope 112 to more quickly accelerate after the stopping portion 184 of the backstop member 180 rotates below the top surface of the transport deck 141.

Afterwards, the stuffed envelope conveys downstream of the insertion station 100 for further processing. The above process for inserting another enclosure collation into another envelope is then repeated.

Key to the reliability of the present invention is that the envelope transport of insertion station 100 consists of the continuous vacuum transport deck 141 and the continuous moving transport belts 121, 123 and 125. Thus there are no components that must be turned on and off, such as rollers, belts or other positive drive mechanisms, typically associated with positive drive systems. Also automatic deskew is achieved with the continuous moving transport because of the nature of the on the non-positive drive of the vacuum and belt arrangement transporting the envelope against the backstop members. Another benefit of the vacuum and belt arrangement is that the constant vacuum holds the lower panel of the envelope as the suction cup lifts the upper panel of the envelope. In this manner the insertion horns pivot easily into the opened envelope. Once the envelope has been inserted with an enclosure collation, the stopping portions of the backstop members pivot underneath the transport deck and the cam portion of the backstop members extend above the transport deck so as to lift a portion of the envelope away from the vacuum transport deck thus reducing friction and reducing jams.

In summary, an insertion station 100 for inserting an enclosure collation into an envelope in a high speed mass mailing inserter system 10 has been described. Although the present invention has been described with emphasis on a particular embodiment, it should be understood that the figures are for illustration of the exemplary embodiment of the invention and should not be taken as limitations or thought to be the only means of carrying out the invention. Further, it is contemplated that many changes and modifications may be made to the invention without departing from the scope and spirit of the invention as disclosed.

What is claimed is:

1. A backstop member for use in an insertion station operative to insert an enclosure collation into an open end of an envelope, the insertion station having a deck with a transport mechanism for conveying an envelope, an opening mechanism for opening an envelope and a backstop member mounted below the deck for stopping the envelope in the insertion station preparatory to insertion of the enclosure collation, the backstop member comprising:

an elongate stopping portion having a substantially planar surface configured to abut against and prevent travel of an envelope in the insertion station being driven by the transport mechanism of the deck when the elongate stopping portion is caused to extend above the deck; and a cam portion having an ellipsoid configuration dimensioned to cause a portion of the envelope being driven by the deck transport mechanism to travel over the ellipsoid configuration and away from the deck in the insertion station when the cam portion is caused to extend above the deck.

2. A backstop member as recited in claim 1, wherein the backstop member is rotatably mounted below the deck of the insertion station.

3. A backstop member as recited in claim 2, further including first and second elongate stopping portions located approximately 180° apart from one another.

4. A backstop member as recited in claim 3, further including first and second cam portions located approximately 180° apart from one another wherein each respective cam portion is located between the first and second elongate stopping portions.

5. A system for transporting, deskewing and stopping an envelope in an envelope insertion station, comprising:

a plurality of laterally spaced, continuously moving, endless transport belts;

a stationary vacuum deck having longitudinal grooves, each of the grooves accommodating an upper reach of a corresponding one of the continues moving transport belts, the vacuum deck including a plurality of vacuum ports arranged in longitudinal rows, each of the rows being adjacent at least one of the transport belts wherein vacuum is continuously present at each vacuum port; and a plurality of stop members located at the downstream end of the vacuum deck wherein vacuum at the vacuum ports urge an envelope against the continuously moving transport belts which transport the envelopes to the stop members, each stop member including:

an elongate stopping portion having a substantially planar surface configured to abut against and prevent travel of an envelope in the insertion station being driven by the transport belts when the elongate stopping portion is caused to extend above the vacuum deck; and a cam portion having an ellipsoid configuration dimensioned to cause a portion of the envelope being driven by the transport belts to travel over the ellipsoid configuration and away from the vacuum deck in the insertion station when the cam portion is caused to extend above the vacuum deck.

6. A system as recited in claim 5, wherein each stop member is rotatably mounted below the vacuum deck.

7. A system as recited in claim 5, wherein each stop member further includes first and second elongate stopping portions located approximately 180° apart from one another.

8. A system as recited in claim 7, wherein each stop member further includes first and second cam portions located approximately 180° apart from one another wherein each respective cam portion is located between the first and second elongate stopping portions.

9. A method of handling an envelope at an insertion station, comprising the steps of:

providing a stationary vacuum deck having a plurality of longitudinal grooves and a plurality of longitudinal rows of vacuum ports;

providing a vacuum source coupled to each of the vacuum ports;

continuously moving endless transport belts through the longitudinal grooves;

feeding an envelope to the upstream end of the vacuum deck;

continuously urging the envelope against the continuously moving transport belts;

pivoting stop members into a stop position to stop the envelope; and pivoting the stop members into a lift position so as to lift at least a portion of the envelope away from the vacuum deck.

* * * * *